United States Patent [19]

Navarro

[11] 4,393,568

[45] Jul. 19, 1983

[54] METHOD FOR ATTACHING WOODEN FORMS TO A CONCRETE SURFACE

[76] Inventor: Ramon Navarro, 10138 E. Rush St., South El Monte, Calif. 91733

[21] Appl. No.: 268,755

[22] Filed: Jun. 1, 1981

Related U.S. Application Data

[62] Division of Ser. No. 30,071, Apr. 16, 1979, abandoned.

[51] Int. Cl.[3] ..... B23P 11/00

[52] U.S. Cl. ..... 29/432; 29/526 R; 29/464; 248/300; 249/219 R; 264/334; 227/119

[58] Field of Search ..... 29/432, 526 R, 464; 52/699, 715; 249/205, 219 R; 248/546, 547, 300; 264/34, 297, 334

[56] References Cited

U.S. PATENT DOCUMENTS

| | | | |
|---|---|---|---|
| 939,005 | 11/1909 | Goedeke | 248/300 X |
| 1,690,295 | 11/1928 | Heltzel | 249/205 X |
| 1,754,215 | 4/1930 | Walper | 52/715 X |
| 1,846,007 | 2/1932 | Levine | 29/432 |
| 2,295,703 | 9/1942 | Wappner | 29/432 |
| 2,563,479 | 8/1951 | Miles | 29/432 UX |
| 3,522,924 | 8/1970 | Arnold, Jr. | 248/546 |
| 3,555,750 | 1/1971 | Banse | 248/300 X |
| 3,708,861 | 1/1973 | Hickey | 29/432 |
| 4,015,814 | 4/1977 | Fowles | 29/432 X |
| 4,094,490 | 6/1978 | Einhorn | 248/547 X |
| 4,101,111 | 7/1978 | Bishop | 249/219 R X |
| 4,104,356 | 8/1978 | Deutsch et al. | 249/219 R X |

*Primary Examiner*—Charlie T. Moon
*Attorney, Agent, or Firm*—Keith D. Beecher

[57] ABSTRACT

A method which involves an improved fastener member or form bracket for use in attaching a wooden form to a concrete surface, is disclosed. The form bracket comprises a base plate configured to be disposed substantially abutting the concrete surface, and a side plate attached to the base plate. The side plate is configured to be disposed abutting the wooden form. Apertures are provided in the base plate for insertion of a fastener member, such as a nail, to attach the form bracket to the concrete surface. At least one pair of apertures configured for the receipt of a staple of a predetermined size is provided in the side plate. A standard size staple may be driven through the pair of apertures into the wooden form to attach the side plate to the wooden form.

4 Claims, 4 Drawing Figures

METHOD FOR ATTACHING WOODEN FORMS TO A CONCRETE SURFACE

This application is a division of Copending Application Ser. No. 30,071, filed Apr. 16, 1979 now abandoned, in the name of the present inventor.

BACKGROUND OF THE INVENTION

1. Field of the Invention

The present invention is directed to a device for fastening objects to a concrete surface, and more particularly to a device for temporarily fastening wooden forms to a concrete surface.

2. Brief Description of the Prior Art

The prior art is well aware of the process of manufacturing a concrete wall or wall section on a substantially flat, hard concrete surface. More particularly, it is established practice in the construction industry to pour several walls or wall sections of a building on a previously poured and hardened concrete foundation of the building under construction.

In order to make a wall section in the above described manner, an area of the concrete foundation which corresponds to the dimensions of the desired wall section is fenced off by a plurality of wooden forms. The wooden forms are attached to the concrete foundation so as to prevent their dislocation, particularly their dislocation in a lateral direction. The surface of the concrete foundation is wetted with a suitable hydrocarbon fluid, such as diesel fluid, in order to prevent adherence of the newly formed concrete wall section to the concrete foundation. Concrete mix is then poured into the area fenced off by the wooden forms. After hardening of the newly poured concrete, the wooden forms are removed and the concrete wall section is lifted off the foundation for incorporation into the building.

According to usual practice in the prior art, wooden fastener members are used to prevent lateral dislocation of the wooden forms on the hard concrete surface. These wooden fastener members usually comprise two boards attached to one another at a right angle. A first, horizontally disposed board of the wooden fastener member is placed upon the concrete surface. A second vertically disposed board of the fastener member abuts, with its narrower side, the wooden form. A plurality of holes or apertures are drilled through the first board into the concrete surface. Nails are inserted through the horizontally disposed board into these apertures to temporarily hold the wooden fastener member in place.

The prior art has also used metal fastener members for temporarily fastening the wooden forms to the concrete surface. The metal fastener members of the prior art comprise two metal surfaces or plates which are disposed at a right angle relative to one another. Holes or apertures are usually provided in both metal plates for inserting nails respectively into the concrete surface and into the wooden form. In one particular embodiment of a metal fastener member of the prior art, a wooden dowel is fitted into a horizontally disposed plate of the fastener member. In the process of attaching the fastener member to the concrete surface, a hole is drilled through the wooden dowel into the concrete surface, and a nail is inserted. One or more nails are then driven into the wooden form through apertures provided on a vertically disposed plate of the fastener member.

It is also established practice in the prior art to provide a circular aperture in the horizontally disposed plate of the metal fastener member through which a somewhat smaller aperture may be drilled into the concrete surface. These apertures may be dimensioned to accommodate more than one nail. Usually two or three nails are force fitted into the pre-drilled aperture in the concrete. The several nails forced into the single aperture usually provides an attachment of greater strength than a single nail simply inserted into a predrilled hole.

It is readily apparent to those familiar with the construction industry that an operator must be able to attach the fastener member to the concrete surface and to the wooden form in a relatively short period of time, preferably within a few seconds. Moreover, it is highly desirable that the fastener member be reusable and therefore readily removable both from the concrete surface and from the wooden form.

It has been the experience of the prior art that wooden fastener members are relatively expensive to manufacture. Furthermore they are all too often damaged or destroyed while they are being removed from the concrete surface. Although the metal fastener members of the prior art are resuable, they usually have not been attachable to the wooden forms in a desired short period of time. For the above stated reasons, there is still a need in the prior art for an improved fastener member having the features of the fastener member of the present invention.

SUMMARY OF THE INVENTION

It is an object of the present invention to provide a method which involves a relatively inexpensive fastener member or form bracket for fastening wooden forms to a concrete surface.

It is another object of the present invention to provide a method which involves a fastener member or form bracket which can be rapidly attached to a concrete surface and to a wooden form.

It is still another object of the present invention to provide a fastener member or form bracket which is reusable.

These and other objects and advantages are attained by a fastener member or form bracket having a base member configured for a disposition abutting a hardened concrete surface, and a side member orthogonally disposed relative to the base member. At least one aperture is provided in the base member for inserting a fastener therethrough into a predrilled aperture in the concrete surface. The side member which is configured to be disposed abutting the wooden form, has at least one pair of apertures. The apertures are spaced for alignment with a staple of a predetermined size. A staple gun is then used to force a staple through the pair of apertures into the wooden form.

The features of the present invention can be best understood together with further objects and advantages by reference to the following description, taken in connection with the accompanying drawings in which like numerals indicate like parts.

DESCRIPTION OF THE PREFERRED EMBODIMENT

The following specification taken in conjunction with the drawings sets forth the preferred embodiment of the present invention in such a manner that any person skilled in the mechanical and building arts can use the invention. The embodiments of the invention disclosed herein are the best modes contemplated by the inventor for carrying out his invention in a commercial environment, although it should be understood that various modifications can be accomplished within the parameters of the present invention.

Figure 1:
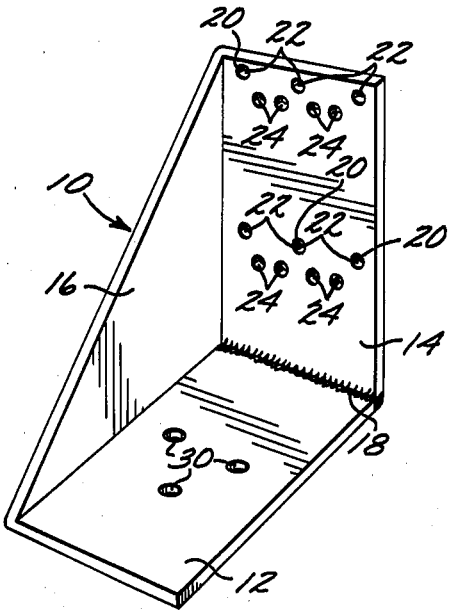
FIG. 1 is a perspective view of a first specific embodiment of a form bracket used in the method of the present invention.

Referring now to the perspective view of FIG. 1, a first specific embodiment of the form bracket 10 of the present invention is disclosed. The form bracket 10 includes a horizontally disposed base member or plate 12 and a substantially vertically disposed side member or plate 14. A reinforcing plate 16 abuts one side of both the base plate 12 and of the side plate 14 in such a manner that the reinforcing plate 16 is at a right angle to both the base plate 12 and to the side plate 14. As it is readily apparent to those skilled in the mechanical arts, the entire form bracket 10 may be manufactured from one piece of metal plate which is bent into the herein shown configuration by a suitable press. After the form bracket 10 is bent into the desired configuration by the press, the side plate 14 and the base plate 12 are welded together on their respective abutting sides. A filet of the weld is designated as 18 on the drawing figures. In the specific embodiments described here, the form bracket 10 is manufactured from approximately 3/16 of an inch thick heat treated iron plate.

The side plate 14 incorporates a plurality of apertures generally designated as 20, which are spaced to form pairs of apertures respectively designated as 22 and 24. The distance between the two apertures 20 of the first pair 22 is 1 3/16" in the first specific embodiment of the form bracket 10 of the present invention. The apertures 20 of the first pair 22 serve the purpose of receiving a pair of alignment probes 25 which are optionally provided on a staple gun. The staple gun and the alignment probes 25 are illustrated on FIG. 4.

The distance between the two apertures 20 of the second pair 24 is $\frac{3}{8}$". This distance corresponds to the size of a standard staple widely used in the construction industry. The second pair 24 of apertures 20 is always disposed below the first pair 22 of apertures 20 in a predetermined configuration which corresponds to the geometric relationship of the alignment probes 25 to a staple which may be ejected from the staple gun.

The purpose of the alignment probes 25 and of the hereinbefore described geometric relationship of the apertures 20 relative to one another will be readily understood as the use of the form bracket 10 of the present invention is further explained below.

The base plate 12 of the first specific embodiment of the form bracket 10 of the present invention incorporates three apertures 30 as is shown in FIG. 1. The apertures 30 are not designed to accomodate staples, although they may also be designed for that purpose. As it is further elaborated below, the apertures 30 serve the purpose of accomodating suitable fastener members such as nails 32, shown on FIG. 4, which temporarily attach the form bracket 10 to a concrete surface 34. The concrete surface 34 is shown on FIGS. 3 and 4.

Figure 3:
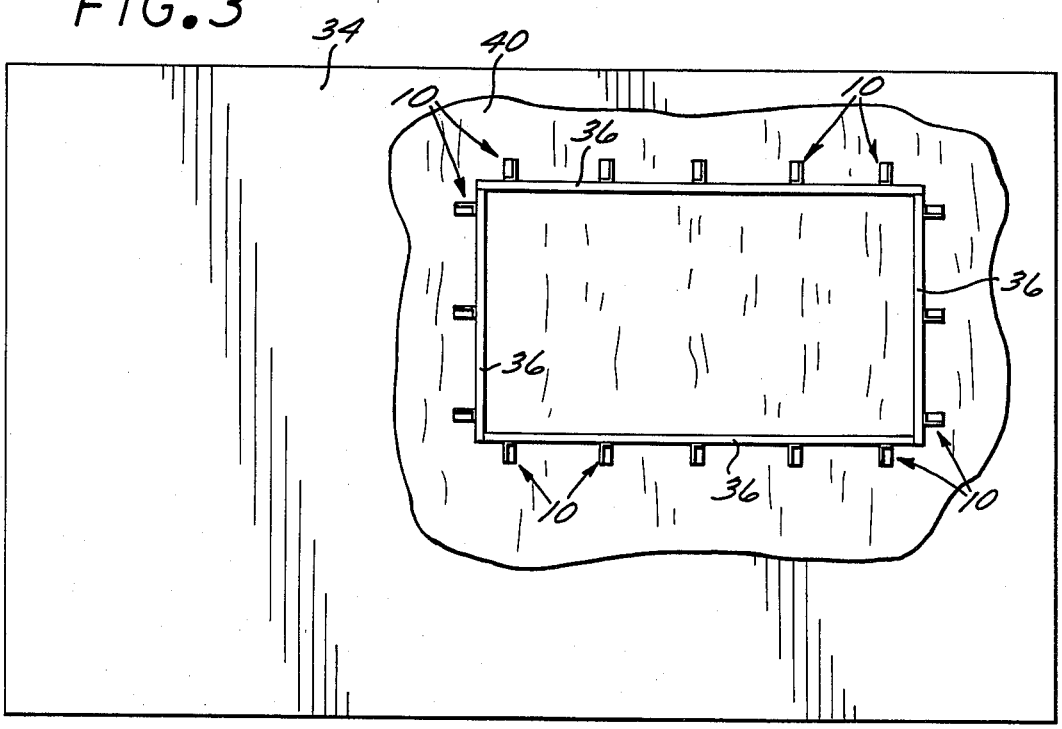
FIG. 3 is a top view of a plurality of wooden forms fencing off an area on a concrete surface, the wooden forms being held in position by a plurality of form brackets comprising the first specific embodiment of the present invention.
Figure 4:
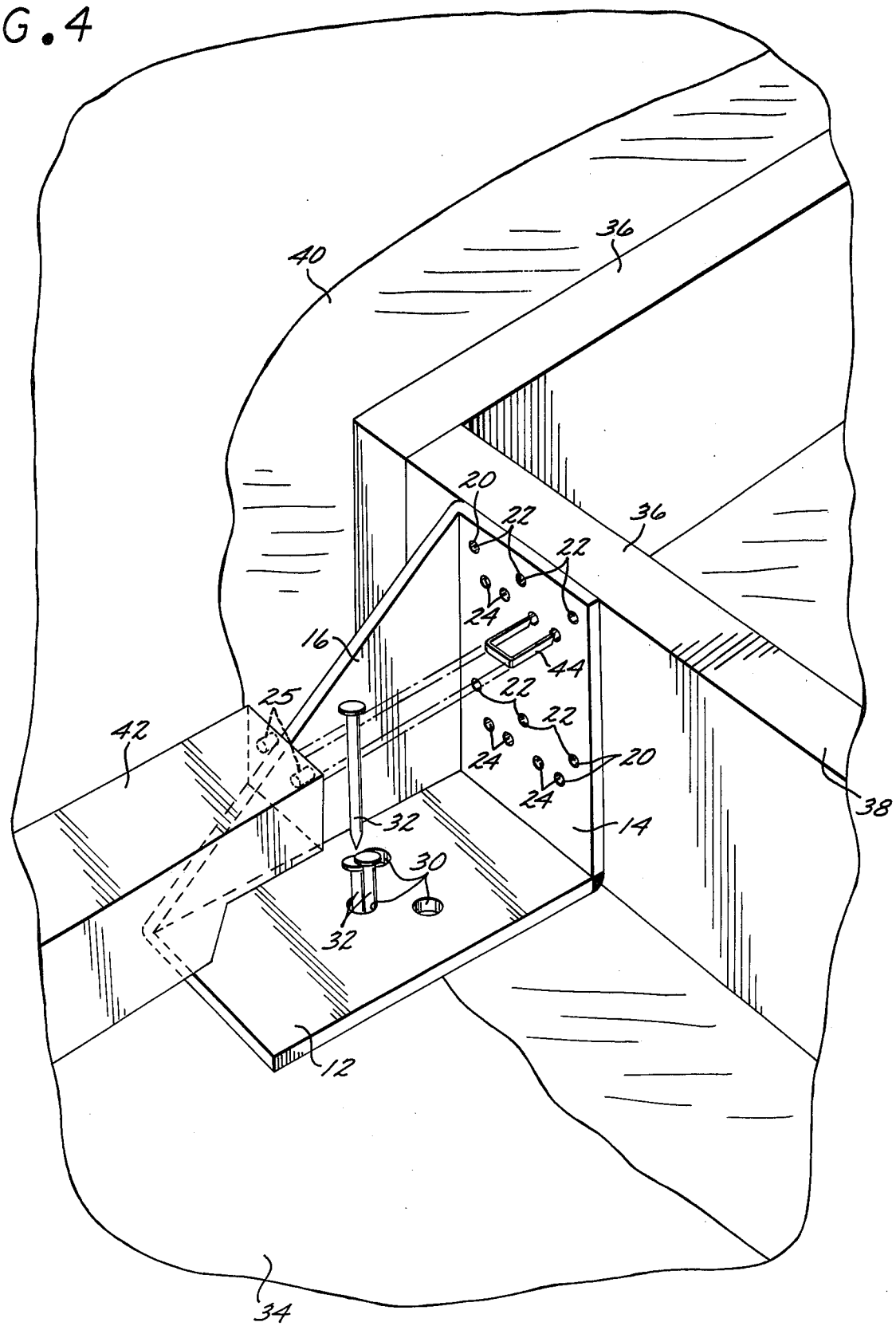
FIG. 4 is a partially exploded perspective view of the first specific embodiment of the form bracket of the present invention, the view showing the attachment of the form bracket to a concrete surface and to a wooden form.

Referring now to the perspective view of FIG. 4, attachment of the first specific embodiment of the form bracket 10 of the present invention to the concrete surface 34 and to a wooden form 36 is disclosed. According to standard practice in the construction industry the wooden form 36 usually comprises a board 38 cut to a desired predetermined length from 2×8" lumber. Usually four of the wooden forms 36 are laid upon the hardened concrete surface 34 so as to fence off an area corresponding to the dimensions of a concrete wall or wall section which is to be poured. FIG. 3 shows the disposition of four wooden forms 36 laid upon the concrete surface 34 and held in position by a plurality of form brackets 10 of the present invention. A suitable hydrocarbon fluid, usually diesel fluid, schematically shown as 40 on FIGS. 3 and 4 is poured upon the concrete surface 34 in order to prevent adherence of the newly poured concrete wall section to the already hardened concrete surface 34.

Referring to FIG. 4, the first specific embodiment of the form bracket 10 of the present invention is shown disposed with its side plate 14 abutting the wooden form 36. The base plate 12 lies flatly over the concrete surface 34. In the first specific embodiment of the form bracket 10, the apertures 30 provided in the base plate 12 have a diameter of 5/16". At least one hole or aperture (not shown) is drilled through one of the apertures 30 into the concrete surface 34 by a suitable drill having an approximately $\frac{1}{2}$" masonry drill bit (not shown). FIG. 4 shows insertion of three nails 32 through aperture 30 into the aperture (not shown) drilled into the concrete surface 34. The nails 32 are of such a dimension that the first two nails 32 are placed without resistance into the aperture 30 while the third nail is driven therein by a hammer (not shown). A sufficiently stable attachment of the form bracket 10 to the concrete surface 34 is obtained in this manner, although it may be desirable to fasten the base plate 12 of the form bracket 10 to the concrete surface 34 through more than one of the apertures 30.

After the base plate 12 has been fastened to the concrete surface 34, a staple gun schematically shown on FIG. 4 as 42, is used to drive a staple 44 through any one of the second pair of apertures 24 into the wooden form 36. In the process of driving the staple 44 into the wooden form 36, the alignment probes 25 of the staple gun 42 are positioned within the first pair of apertures 22. These are located above the second pair of apertures 24 selected by an operator. In this manner the form bracket 10 is readily secured to both the concrete surface 34 and to the wooden form 36.

It will be readily appreciated by those skilled in the building arts that the form bracket 10 of the present invention enables an operator to use a staple gun for very rapid attachment of the form bracket 10 to the wooden form 36. Using the staple gun 42 is a significantly faster process than using nails, as it was done in the prior art. Moreover, when disassembly of the form bracket 10 from the wooden form 36 becomes necessary, the staples 44 may be more rapidly removed from the wooden form 36 than nails.

Since several pairs of apertures 22 and 24 of identical, predetermined configuration and distance are provided on the side plate 14, an operator has the option to select between any one of the second pairs 24 for receiving the staple 44. The operator's selection may be dictated by the height of the wooden form 36. This, in turn, may be dependent on the thickness of the wall section about to be poured.

Figure 2:
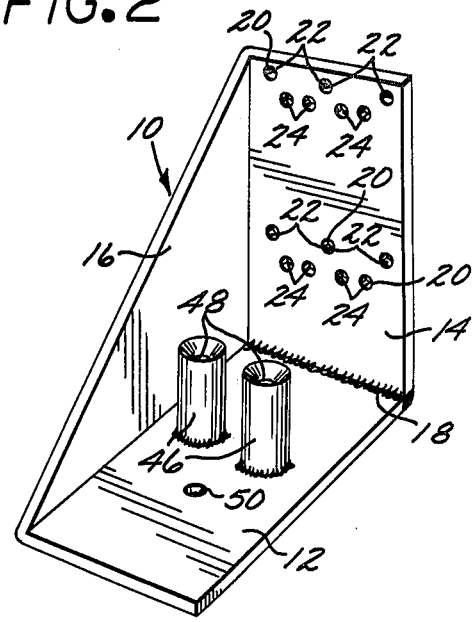
FIG. 2 is a perspective view of a second specific embodiment of the form bracket of the present invention.

Referring now to FIG. 2, a second specific embodiment of the form bracket 10 of the present invention is disclosed. As this is readily discernable from an inspection of FIG. 2, the second specific embodiment is indentical in most respects to the first specific embodiment. However, instead of simply providing three holes on the base plate 12, a pair of substantially vertically disposed, spaced tubular members 46 are fixedly attached to the base plate 12. Each tubular member 40 incorporates an aperture 48 which extends throughout the entire body of the tubular member 46 and through the base plate 12. The tubular members 46 serve as guides for nails (not shown) which may be inserted through the tubular members 46 into apertures (not shown) drilled in the concrete surface 34. In order to provide a further option for the operator, a circular aperture 50 is also provided in the base plate 12 of the second specific embodiment. The aperture 50 may be used for insertion of nails 32 in the same manner as it is described above and depicted on FIG. 4 in connection with the description of the first specific embodiment.

What has been described above is an improved form bracket which greatly facilitates the assembly and disassembly of wooden forms to a hard concrete surface. Several modifications of the present invention may become readily apparent to those skilled in the mechanical and construction arts. A particularly apparent modification of the form brackets 10 of the present invention would involve changing the distance between the respective pairs of apertures so as to accomodate a different size staple, and to accomodate alignment probes spaced at a different distance than the distance described above. In light of the possibility of various apparent modifications, the scope of the present invention should be interpreted solely from the following claims.

What is claimed is:

1. A method of forming a tilt-up concrete wall panel comprising: aligning wooden form members on a horizontal slab of set concrete to define a length and width of a tilt-up concrete panel, placing a plurality of brackets in abutment with the exterior surfaces of the wooden form members, each of the brackets having a vertical side plate abutting the outer surface of the adjacent wooden form member and a horizontal base plate perpendicularly disposed relative to the side plate and extending outwardly from the adjacent wooden member in abutment with the top surface of the horizontal slab, said vertical side plate having a first pair of alignment apertures and a second pair of staple receiving apertures, driving a fastener through an aperture in the base plate to attach the base plate to the horizontal slab, positioning a pair of alignment probes of a staple gun into said first pair of apertures to align a staple with said second pair of apertures, and driving said staple through said second pair of apertures in the side and plate into the adjacent wooden form member.

2. The method defined in claim 1, in which the bracket member further comprises a triangular-shaped reinforcing plate positioned at one edge of the base plate and the side plate and disposed in a plane perpendicular to the planes of the base plate and side plate.

3. The method defined in claim 1, in which the apertures on the vertical side plate are spaced at a distance of approximately $\frac{3}{8}$ of an inch from one another.

4. The method defined in claim 1, in which the base plate includes a pair of spaced tubular members, each tubular member containing an aperture and acting as a nail guide for inserting and guiding a nail through the tubular member into the concrete surface of the slab.

* * * * *